United States Patent [19]

Ferrazza

[11] Patent Number: 4,624,414

[45] Date of Patent: Nov. 25, 1986

[54] DEFLECTOR TYPE SPRAY NOZZLE FOR FIRE PROTECTION AND OTHER SYSTEMS

[75] Inventor: Gerald Ferrazza, Schaumburg, Ill.

[73] Assignee: Spraying Systems Co., Wheaton, Ill.

[21] Appl. No.: 600,118

[22] Filed: Apr. 13, 1984

[51] Int. Cl.[4] ..... B05B 1/26; B05B 1/34

[52] U.S. Cl. ..... 239/467; 239/504; 239/524

[58] Field of Search ..... 239/467, 498, 504, 518, 239/524, 487, 488

[56] References Cited

U.S. PATENT DOCUMENTS 2,539,061 1/1951 Coles ..... 239/488
2,709,623 5/1955 Glynn ..... 239/488

FOREIGN PATENT DOCUMENTS 1106820 12/1955 France ..... 239/524
1028521 5/1966 United Kingdom ..... 239/524

*Primary Examiner*—Andres Kashnikow
*Attorney, Agent, or Firm*—Leydig, Voit & Mayer

[57] ABSTRACT

A deflector type spray nozzle for fire protection systems in marine or land storage spaces with little headroom between the stored items and the ceiling. The nozzle is adapted to discharge a uniformly distributed, symmetrical spray pattern in a nearly horizontal direction so as to reach all ammunition, supplies, or other boxed or crated items within the field of the spray pattern underlying the nozzle. The nozzle would also be useful in applications other than fire protection systems where the headroom is limited and a symmetrical, uniformly distributed spray pattern in a nearly horizontal direction is needed.

8 Claims, 5 Drawing Figures

DEFLECTOR TYPE SPRAY NOZZLE FOR FIRE PROTECTION AND OTHER SYSTEMS

BACKGROUND OF THE INVENTION

The present invention relates to a fluid spray nozzle for use in fire protection systems and, more specifically, to a spray nozzle of the deflector type adapted to discharge water or other extinguishing fluid in a relatively large circular spray pattern at a level very close to the ceiling.

Overhead sprinkler systems have been widely used for fire protection in numerous kinds of buildings and storage spaces for many years. In a typical prior installation, the spray or sprinkler nozzles are mounted on the ceiling, or in depending relation from the ceiling, at a level which affords several feet of headroom over the objects or equipment in the room. The nozzles are connected with a pipe recessed in or spaced below the ceiling. Flow of water through such nozzles is usually triggered by the melting of a fusable metal link which permits one or more nozzles to open in response to the heat generated by a fire in the room.

In certain storage installations, such as those which exist on board naval vessels or in certain types of warehouses using tiered storage racks, the space between the stored material and the overhead or ceiling may be limited to just a few inches. With such limited headroom, the spray pattern from a conventional nozzle tends to be limited to an unduly small area, or be of a hollow cone configuration, leaving the area below the nozzle unwatered. For adequate fire protection in such a storage area, it would thus be necessary to use a large number of conventional nozzles spaced very closely together in order to be certain that the flammable material in the area is adequately covered by the spray.

SUMMARY OF THE INVENTION

One object of the present invention is to provide a spray nozzle for fire protection systems adapted to discharge a spray pattern of water or other extinguishing liquid in a nearly horizontal direction, enabling the nozzle to cover a substantial area in the magazine of a naval vessel or in a warehouse despite extremely small overhead clearance.

Another object of the invention is to provide a spray nozzle for fire protection systems of the foregoing type adapted to discharge a nearly horizontal spray pattern wherein the spray is distributed substantially uniformly over the area below the nozzle.

A further object of the invention is to provide a spray nozzle for a fire protection system of the above type wherein the spray pattern is symmetrical about the nozzle. The foregoing objects are accomplished by utilizing combined structural features in the nozzle which impart an extremely high velocity swirl to the discharged liquid. The swirling liquid is then impinged directly upon a deflector means, breaking into fine droplets issuing from the nozzle in a horizontal spray pattern spread over a wide area before falling upon the underlying objects or equipment supporting the fire.

DETAILED DESCRIPTION OF THE INVENTION

Figure 1:
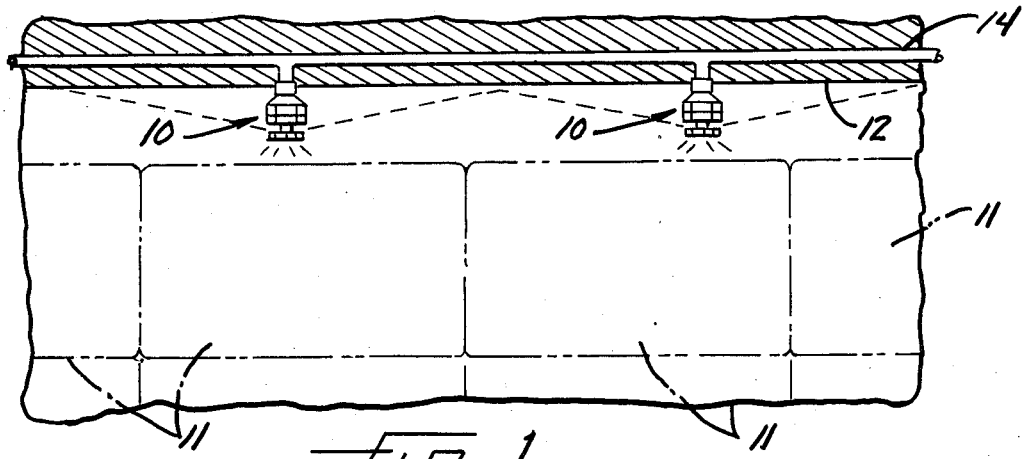
FIG. 1 is a vertical sectional view through a portion of a fire protection system showing two neighboring spray nozzles embodying the present invention, the underlying stored material or equipment being indicated diagramatically.

Referring more specifically to FIGS. 1–5, the invention is there exemplified in an illustrative spray nozzle 10 adapted for use in ceiling mounted fire protection systems for marine or land installations having very little headroom. As indicated in FIG. 1, the cargo or stored inventory 11, which may, for example, be ammunition, supplies, boxed or crated goods, are stacked to within a few inches of the ceiling or overhead 12. A plurality of spray nozzles 10 are connected to and supported by a fire main 14 attached, and in this instance recessed within, the ceiling or overhead 12. The nozzles 10 may have fusable metal link valve actuators (not shown) adapted to admit water or other fluid from the fire main into the nozzles in the event of a fire. Alternatively, appropriate heat sensor means separate from the nozzles may be provided to establish communication between the fire main and the nozzles in the event of a fire.

Figure 2:
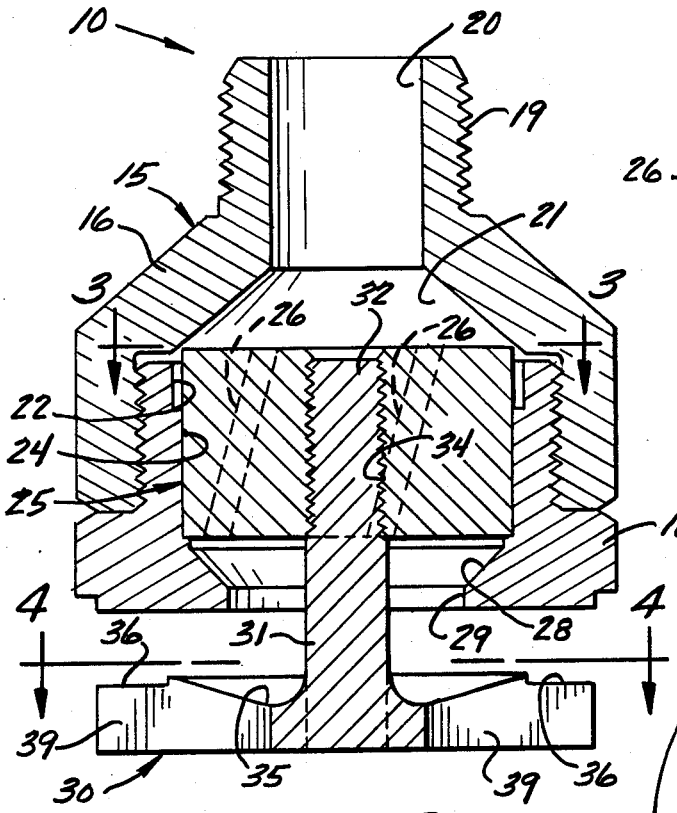
FIG. 2 is an enlarged vertical sectional view through the exemplary spray nozzle illustrated in FIG. 1.
Figure 3:
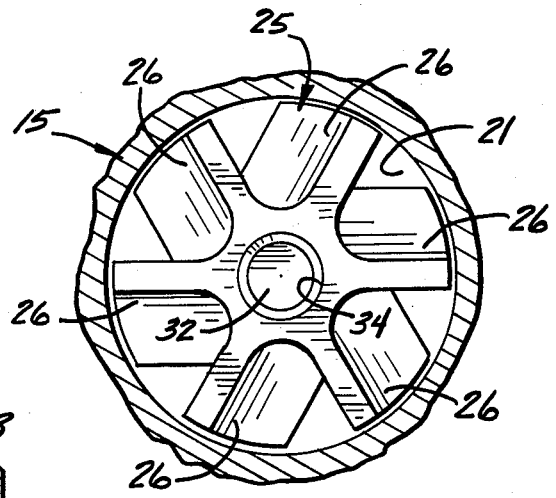
FIG. 3 is a horizontal sectional view through the spray nozzle shown in FIG. 2, taken in the plane of the line 3—3.

As shown in greater detail in FIGS. 2 and 3, the exemplary spray nozzle 10 comprises a hollow body 15 having an upper shell 16 and a lower shell 18 threadedly attached to the upper shell. Adjacent its upper end, the diameter of the body is stepped down to define an externally threaded neck 19. The latter is adapted for engagement with an appropriate coupling attaching the nozzle 10 to the fire main 14. The neck 19 has an inlet passage 20 which communicates with a laterally enlarged vane chamber 21. The chamber 21 has frustoconical entry portion communicating with the inlet 20 and which opens into a counterbore 22 and a relatively long cylindrical bore 24. The cylindrical bore 24 is in this instance defined in the lower shell 18 and telescopically houses a multibladed vane 25. The latter is of generally cylindrical configuration with a plurality of helical passages 26 defined therein. The vane 25 in this case happens to be press fit into the bore 24 of the lower shell to preclude rotation of the vane due to reaction of the liquid flow therethrough when the spray nozzle is operating.

The vane chamber 21 opens at its downstream end into an annular whirl chamber 28 of somewhat shorter length than the vanechamber. The whirl chamber 28 receives liquid exiting at high rotational velocity from the vane 25 and discharges it through body outlet 29. Because the whirl chamber 28 decreases in diameter toward the outlet 29, the rotational velocity of the liquid is increased substantially by the time it leaves the outlet. In the absence of further guiding or deflecting means, the whirling liquid emerging from the outlet 29 would form a spray of conical shape. The diameter of such a spray pattern would tend to be small, particularly in a storage area with limited headroom.

In accordance with the invention, provision is made in the nozzle 10 for discharging the spray in a direction that is approximately horizontal or slightly above horizontal so that the spray pattern covers a substantial area; diffusing the spray with substantial uniformity throughtout the entire area of the spray pattern; and maintaining a spray pattern which is substantially symmetrical with respect to the spray nozzle.

Figure 4:
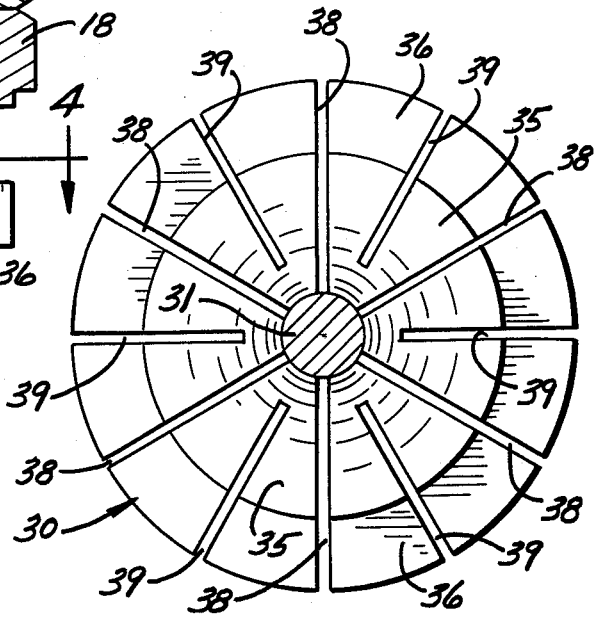
FIG. 4 is a horizontal sectional view taken in the plane of the line 4—4 in FIG. 2 and illustrating the upper face and structure of the deflector plate.
Figure 5:
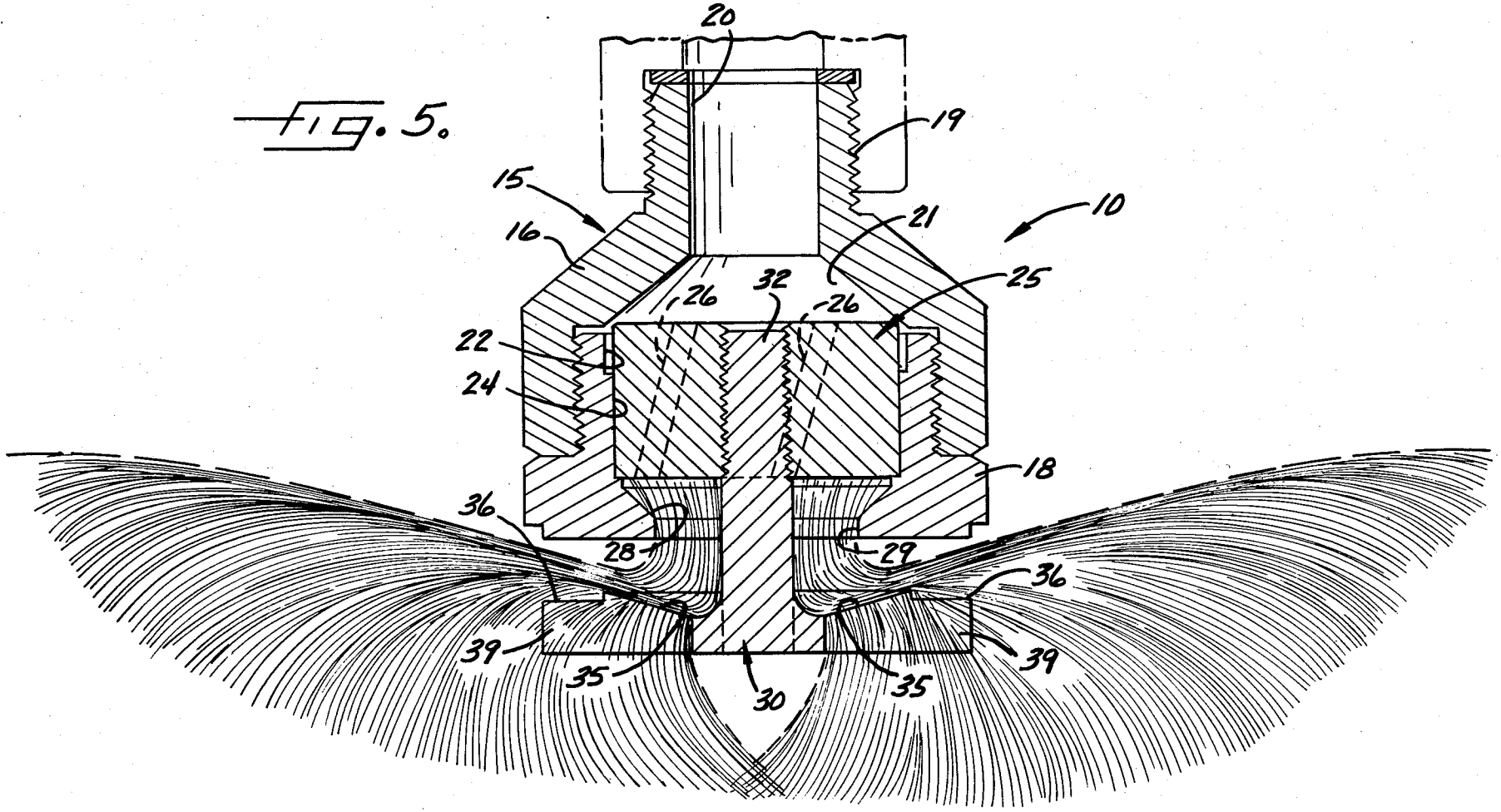
FIG. 5 is an enlarged vertical sectional view corresponding to FIG. 2, but with the liquid flow from the nozzle illustrated diagrammatically.

Pursuant to the foregoing objectives, a deflector plate 30 is fixed in relatively closely spaced relation to the outlet 29 of the nozzle body 15 (FIGS. 2, 4 and 5). The plate 30 in this instance is formed with a central stem 31 having a threaded upper end portion 32 which engages a tapped hole 34 in the center of the vane member 25. The upper face of the deflector plate 30 has a shallow dished, recess 35 surrounded by a flat annular peripheral area 36. The deflector 35 is rigidly supported in position to intercept the major portion of the swirling spray from the outlet 29 and to change its direction by approximately 90 degrees to horizontal or slightly above horizontal.

In order to diffuse the spray more uniformly throughout the area of the spray pattern, the deflector plate 30 is fashioned with a plurality of equally spaced, alternating radial slots 38, 39 passing through the full thickness of the plate. Each of the slots 38 extends from the stem 31 to the outer edge of the plate. Each of the slots 39 starts at approximately the deepest point of the recess 35 and extends to the outer edge of the plate 30.

Turning now to FIG. 5, the operation of the spray nozzle 10 has been illustrated diagrammatically. Pressurized liquid from the fire main or other supply source enters the vane chamber 21 via inlet 20 at relatively high velocity. It enters the helical passages 26 which impart a high rotational velocity component to the liquid and convey it to the whirl chamber 28. The latter, being of inverted, generally frustoconical shape, increases the rotational velocity component still further and discharges the liquid via body outlet 29 in the form of an annular column whirling about the plate support stem 30. The whirling liquid column is then intercepted by the deflector plate 30. The dished annular deflector 35, intersected by radial slots 38, 39, tends to break the whirling liquid into fine droplets, deflecting many of them outwardly in a direction generally horizontal or slightly above horizontal. Other droplets pass downwardly and outwardly through the slots 38, 39. The combined action of the structure described above, including full cone nozzle with single orifice, helical vane, and slotted deflector plate, creates a uniform, symmetrical horizontal spray pattern over a wide area before falling upon the underlying objects or equipment. The spray in the central area of the pattern underlying the nozzle is substantially as uniform as that adjacent the periphery of the spray pattern.

By reason of the construction and operation described above, it will be appreciated that the nozzle 10 is well adapted for efficient fire protection service, or other applications, in minimal headroom spaces. The simple, rugged construction of the nozzle makes it capable of operating reliably over a long period of time.

I claim as my invention:

1. A deflector type spray nozzle for fire protection systems and the like adapted to discharge a spray pattern in a nearly horizontal direction and comprising, in combination (a) a hollow body having an inlet adapted for connection to a fire main;

(b) means defining a vane chamber in said body substantially larger in diameter than said inlet;

(c) means defining a frustoconical whirl chamber adjacent the end of said body remote from said inlet and defining an outlet for said body;

(d) a multi-bladed vane telescopically housed within said vane chamber having a plurality of generally helical passages defined therein communicating between said inlet and said whirl chamber for imparting a tangential swirling movement to liquid passing through said helical passages;

(e) means in said body precluding rotation of said vane relative thereto; and (f) deflector plate means having a diameter greater than the diameter of said vane and whirl chambers connected to said body and disposed in relatively closely spaced relation to said body outlet, said deflector plate means having a concave deflector section opposite said outlet and being formed with a plurality of radial diffusion slots extending from the periphery of said deflector plate means into intersecting relation with said concave deflector section for diffusing swirling liquid exiting said outlet in a substantially horizontally directed and symmetrical spray pattern with substantial uniformity in distribution throughout the area of the spray pattern, and said deflector plate means being spaced sufficiently from said body outlet such that the body and deflector plate means do not define a flow restriction for nozzling the diffused liquid leaving the deflector plate means.

2. The combination recited in claim 1, wherein said deflector plate is fixed to said body by means of a central stem.

3. The combination set forth in claim 2, wherein said central stem of said deflector plate is disposed in threaded engagement with said vane.

4. The combination set forth in claim 2, wherein said central stem is centered in said whirl chamber and the liquid emerging from said whirl chamber defines an annular column whirling about said stem.

5. The combination recited in claim 2, in which a first set of angularly spaced diffusion slots in said deflector plate extends from said central stem to the outer periphery of said plate, and a second set of angularly spaced diffusion slots alternating with said first set extends from a concentric circle spaced radially outward from said central stem to the outer periphery of said plate.

6. The combination set forth in claim 1, wherein the axial length of said vane chamber is substantially greater than that of said whirl chamber.

7. The combination set forth in claim 1 wherein said concave section extends radially outward beyond the perimeter of said outlet.

8. The combination set forth in claim 7 in which said deflector plate includes a substantially flat annular outer peripheral area surrounding said concave section.

* * * * *